US005243866A

United States Patent [19]

Mayer

[11] Patent Number: 5,243,866

[45] Date of Patent: Sep. 14, 1993

[54] STARTING DEVICE FOR INTERNAL COMBUSTION ENGINES

[75] Inventor: Martin Mayer, Sersheim, Fed. Rep. of Germany

[73] Assignee: Robert Bosch GmbH, Stuttgart, Fed. Rep. of Germany

[21] Appl. No.: 838,231

[22] PCT Filed: May 26, 1990

[86] PCT No.: PCT/DE90/00387

§ 371 Date: Feb. 26, 1992

§ 102(e) Date: Feb. 26, 1992

[87] PCT Pub. No.: WO91/03643

PCT Pub. Date: Mar. 21, 1991

[30] Foreign Application Priority Data

Aug. 31, 1989 [DE] Fed. Rep. of Germany ..... 3928795

[51] Int. Cl.[5] ..... F02N 15/06

[52] U.S. Cl. ..... 74/6; 74/7 A; 74/527; 335/131; 384/610; 384/611; 267/162; 16/24

[58] Field of Search ..... 74/6, 7 A, 527; 335/131; 384/610, 611; 267/162; 16/24, 25, 27, 21

[56] References Cited

U.S. PATENT DOCUMENTS

| | | | |
|---|---|---|---|
| 2,808,607 | 10/1957 | Urso | 16/24 |
| 2,819,486 | 1/1958 | Dick | 16/24 |
| 3,463,564 | 8/1969 | Moore | 384/611 |
| 4,852,417 | 8/1989 | Tanaka | 335/131 X |

FOREIGN PATENT DOCUMENTS

| | | | |
|---|---|---|---|
| 1100064 | 9/1955 | France | 384/611 |
| 2-256911 | 10/1990 | Japan | 384/610 |
| 110004 | 10/1917 | United Kingdom | 384/610 |
| 118665 | 6/1944 | United Kingdom | 384/611 |

*Primary Examiner*—Allan D. Herrmann
*Assistant Examiner*—William O. Trousdell
*Attorney, Agent, or Firm*—Michael J. Striker

[57] ABSTRACT

The starting device includes a starting pinion mounted on a thrust rod and movable between a disengaged and engaged position with an internal combustion engine; a movable switching bolt located in a solenoid; a sphere mounted at an end face of the switching bolt closest to the thrust rod; a disc and a spring device arranged between the sphere and the end face of the switching bolt, the spring device being located between the disc and the end face, and a holding device for retaining the sphere on the end face of the switching bolt. The holding device includes a sleeve-shaped section accommodating the sphere, an end of the sleeve-shaped section being structured as a stop for the disc and the spring device and the disc being located in a recess provided in the end face of the switching bolt so that the spring device presses the disc elastically against the end of the sleeve-shaped section acting as the stop for the disc and the sphere is held in the holding device rotatably, but substantially free of play and substantially free of pressure from the spring device.

4 Claims, 2 Drawing Sheets

STARTING DEVICE FOR INTERNAL COMBUSTION ENGINES

BACKGROUND OF THE INVENTION

The present invention relates to a starting device for an internal combustion engine.

The invention is based on a starting device for internal combustion engines according to German Patent Specification 11 01 052. In this known device, a recess is formed at the free end face of the thrust member of the solenoid armature, which member is constructed as a switching bolt. In the recess, rubber discs are inserted and covered by a steel disc which is also inserted in the recess. On the steel disc, a sphere is loosely arranged and held in the recess by turned-over or flanged edge sections or by the entire flanged edge of the end face. In this arrangement, it is of disadvantage that the starter solenoid must already be assembled before the edge or the edge sections of the switching bolt are turned over against the sphere. It is only then that the rubber discs or else cup springs, acting as spring, are inserted into the recess, the steel disc is placed on top and the sphere is placed on. The turning-over of the edge is then carried out as precision flanging against the sphere. During this process, the sphere must be kept running easily which is made more difficult by the continuous pressure of the rubber discs or cup springs against the steel disc resting against the sphere and requires complicated measures, which are not economical in mass production for maintaining the tolerances and thus the quality of the product.

SUMMARY OF THE INVENTION

It is an object of the present invention to provide a starting device for an internal combustion engine of the above-described type which has none of the above-described disadvantages of the known starting devices.

It is also an object of the present invention to provide a starting device for an internal combustion engine of the above-described type which has a simple reliable holding arrangement for the sphere provided between the thrust member and the thrust rod suitable for economical automated mass production.

According to the invention, the starting device for an internal combustion engine comprises a starting pinion mounted on a thrust rod and movable between a position disengaged from a toothed rim of a drive of an internal combustion engine and another position engaged therewith; a movable switching bolt located in a solenoid and movable against an end of the thrust rod by energizing the solenoid; a sphere mounted at an end face of the switching bolt closest to the thrust rod; a disc and spring means arranged between the sphere and the end face of the switching bolt, the spring means being located between the disc and the end face, and holding means for retaining the sphere on the end face of the switching bolt, the holding means having a sleeve-shaped section accommodating the sphere, an end of the sleeve-shaped section being structured as a stop for the disc and the spring means and the disc being located in a recess provided in the end face of the switching bolt so that the spring means presses the disc elastically against the end of the sleeve-shaped section acting as the stop for the disc and the sphere is held in the holding means rotatably, but substantially free of play and substantially free of pressure form the spring means.

In this connection, it is of advantage that the sphere is arranged rotatably free of play and free of friction and pressure of the pretension of the spring arrangement. It must be considered as a further advantage that the component-related tolerances can be maintained more easily due to the sphere being fixed in a sleeve-shaped section.

It is particularly advantageous that the holding device, as covering cap, envelopes the sphere and enables the sphere to be accommodated with accurate tolerance in a simple manner and that, in addition, the switching bolt exhibiting the sphere and the spring and holding device can be manufactured and checked as a prefabricated structural unit in an automatable process and has support areas to enable the preassembled structural unit of switching bolt to be accurately and simply wedged over in the solenoid.

In another embodiment of the invention the recess in the switching bolt holding the spring means and the disc has an end section having a diameter greater than a remaining portion of the recess and the sleeve-shaped section has a flange held in the end section end at one end thereof and at the other end thereof a circular hole is provided having a peripheral, edge on which the sphere rests and protrudes from the circular hold.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 2:
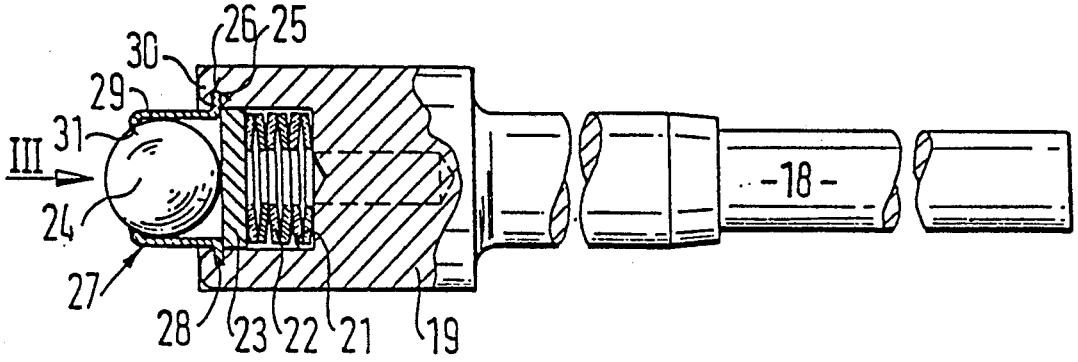
FIG. 2 is a partially cutaway side, partially cross-sectional view of a first embodiment of a prefabricated structural unit for the starting device of FIG. 1 with a sphere and spring means in a holding device according to the invention.
Figure 3:
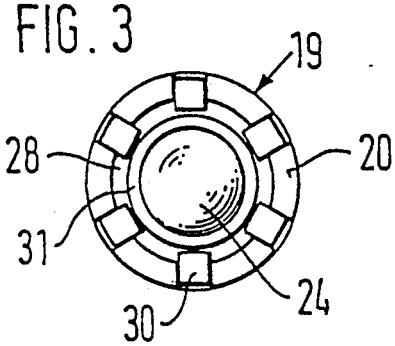
FIG. 3 is a plan view of the structural unit of FIG. 2 seen in the direction of the arrow III in FIG. 2.

A starting device has a starting motor 1 with a hollow drive shaft 2 which carries an armature 3. The drive shaft 2 is rotatably supported in a bearing plate 4 which is mounted in the housing 5 of the starting motor 1. A thrust rod 6 extends through the hollow drive shaft 2. On its end protruding from the drive shaft 2, a starting pinion 7 is mounted. The starting pinion 7 is supported displaceably in a drive bearing 8 of the starting device. The thrust rod 6 can be displaced, together with the starting pinion 7, with respect tot he drive shaft 2 against the force of a restoring spring 9. One end of the restoring spring 9 rests against a sleeve 10 which is held by a stop ring 11 on the thrust rod 6 whereas its other end is supported in a manner known per se and not shown in greater detail against a collar of the drive shaft 2. A solenoid 12, constructed at the same time as a coil element for the starting motor 1, which is mounted on the outside on the bearing plate 4 on the same axis as the drive shaft 2 is provided for displacing the thrust rod 6. The solenoid 12 essentially consists of a base plate 13, in the center of which a sleeve 14 is located which, together with the base plate 13, forms the magnetic core of the solenoid 12. The sleeve 14 is surrounded by a winding former 15 on which the exciter winding 16 of the solenoid 12, consisting of pull-in and holding winding, is arranged. In the winding former 15, a solenoid armature 17 is carried. A switching bolt 18 used as thrust member is mounted on the solenoid armature 17. It protrudes from the winding former 15 and extends through the sleeve 14, forming the magnetic ore, into the hollow drive shaft 2. The end of the switching bolt 18 protruding into the hollow drive shaft 2 has a heat 19 (FIG. 2). At its end face 20, the head 19 is provided with a blind-hole-like recess 21. In the recess 21, three pairs of cup springs 22 are inserted and covered with a steel disc 23. On the steel disc 23, a steel sphere 24 is seated which protrudes beyond the end face 20 of the head 19. The recess 21 has in the vicinity of a stop collar 25 section 26 with a larger diameter into which a holder device comprising a pot-shaped covering cap 27 is inserted. The covering cap 27 has a flange 28 and a sleeve-shaped section 29. The covering cap 27 is pushed over the steel sphere 24. The flange 28 rests against the stop collar 25 and against the steel disc 23. Tab portions 30 of the stop collar 25 surrounding the recess 21, are pressed against the flange 28 at regular angular intervals. As a result, the covering cap 27 is held on the switching bolt 18. The sleeve-shaped section 29 accommodates the steel sphere 24 without play. The covering cap 27 has an exactly centrally stamped circular hole against the bottom edge 31 of which the steel sphere 24 rests. The switching bolt 18, the holding device, the spring means including the cup springs and the sphere can be provided together in a first embodiment of a preassembled structural unit. It can be provided with the "precision flanged" sphere 24 held rotatably without play even before it is inserted into the solenoid 12. The stop formed by the flange 28 for the steel disc 23, onto which the pretensioned pairs of cup springs 22 press, enables the sphere 24 held by the holding device on the switching bolt 18 to operate easily. This required easy-running f the sphere 24 can be set up and tested better by precision flanging before the switching bolt 18 is mounted in the solenoid armature 17. The prefabricated structural unit is inserted into the solenoid 12, the switching bolt 18 protruding with its end 32 through the solenoid armature 17 and a switching lever 33 of the solenoid 12 being attached to the end 32. In this arrangement, the end face 20 of the head 19 of the switching bolt 18 is used as support of the preassembled structural unit for connecting the end 32 in the solenoid 12.

Figure 4:
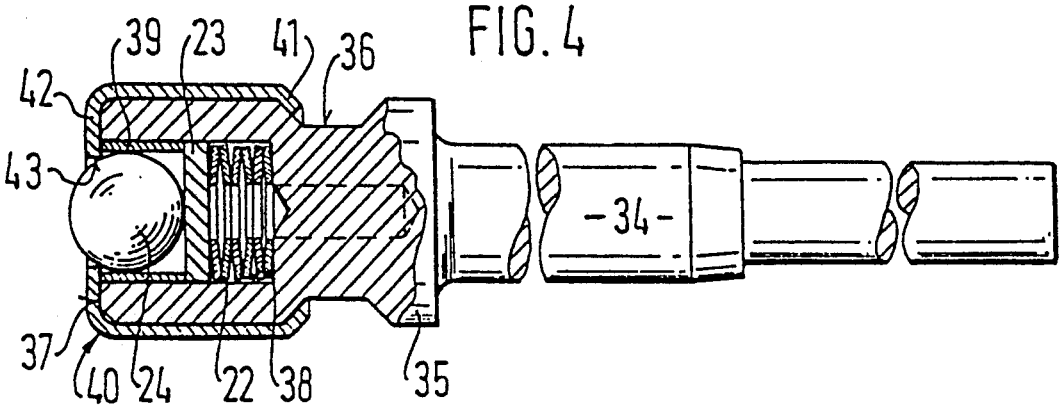
FIG. 4 is a partially cutaway side, partially cross-sectional view of a second embodiment of a prefabricated structural unit for the starting device of FIG. 1 according to the invention.

In the second exemplary embodiment of the preassembled structural unit according to FIG. 4, the switching bolt 34 is provided with a head 35 which has an outer annular groove 36 close to its transition to the switching bolt 34. On the end face 37 of the head 35, a recess 38 is again formed. It has a cylindrical inside wall of constant diameter over its entire axial length. The three pairs of cup springs 22 and the steel disc 23 as well as a cylindrical spacing sleeve 39 are inserted into the recess 38. The steel sphere 24, which slightly protrudes from the recess 38, is accommodated in the spacing sleeve 39. A pot-shaped covering cap 40 is pushed onto the head 35. Its end-face edge section 41 is beaded in the outer annular groove 36 of the head 35 of the switching bolt 34 or rolled into the outer annular groove 36. The covering ca 40 has an accurately stamped hole 43 in the center of its bottom 42. The diameter of the hole 43 is less than the diameter of the sphere 24 so that the sphere 24 slightly protrudes through the hole 41 but is held in the spacing sleeve 39 by the covering cap 40. At the same time, the bottom 42 of the covering cap 40 is used as stop for the spacing sleeve 39 against which, in turn, the steel disc 23 is pressed by the spring force of the pretensioned pairs of cup springs 22. The sphere 24, in turn, is arranged rotatably free of play on the connecting bolt 34 and held without plays. This preassembled structural unit is also inserted into the solenoid 12 and the end of the switching bolt 34 protruding through the solenoid armature 17 and the switching lever 33 are connected like the end 32 of the switching bolt 18 of the first exemplary embodiment. During this wedging-over, the bottom 42 of the covering cap 40 is used as support. The space of the covering cap 27; 40 accommodating the sphere 24 and not being filled up by it is filled with lubricant.

Figure 1:
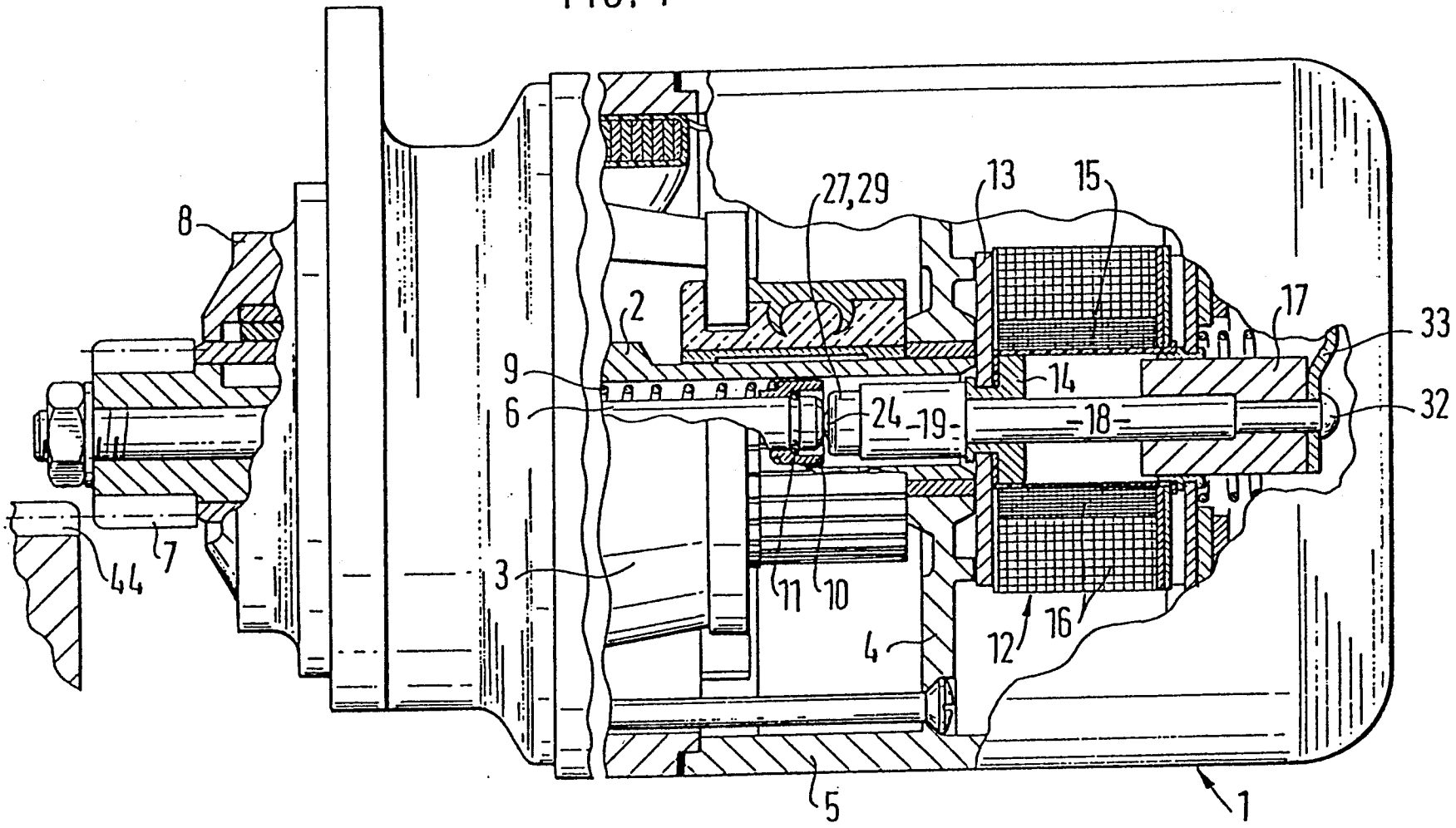
FIG. 1 is a partially cutaway side, partially cross-sectional view of a starting device for an internal combustion engine according to the invention.

In the rest position of the starting device, in which the starting pinion 7 is out of engagement with the tooth rim 44 and the solenoid 12 is not excited, the thrust rod 6, the head 19; 35 together with the switching bolt 18; 34 and the solenoid armature 17 are held in the position shown in FIG. 1 by the restoring spring 9. When the solenoid 12 is excited for engaging the starting pinion 7 and for switching on the starting motor 1, the solenoid armature 17 pushes the thrust rod 6, connected to the starting pinion 7, forward in the direction of the toothed rim 44 against the pressure of the restoring spring 17 via the switching bolt 18; 34 and the had 19; 35 with the sphere 24 and the pairs of cup springs 22. During this process, the switching-on surge of the solenoid 12 is absorbed by the pairs of cup springs 22. Similarly, the surges occurring in the direction of the longitudinal axis of the starting device during the actual starting process at the starting pinion 7 are transferred via the sphere 24 to the pairs of cup springs 22 and damped by these.

While the invention has been illustrated and embodied in a starting device for an internal combustion engine, it is not intended to be limited to the details shown, since various modifications and structural changes may be made without departing in any way from the spirit of the present invention.

Without further analysis, the foregoing will so fully reveal the gist of the present invention that others can, b applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Starting device for an internal combustion engine, said starting device comprising a starting pinion mounted on a thrust rod and movable between a position disengaged from a toothed rim of a drive of an internal combustion engine and another position engaged with the toothed rim; a movable switching bolt located in a solenoid and movable against an end of the thrust rod by energizing the solenoid; a sphere supported on an end face of the switching bolt closest to the thrust rod; a disc and spring means arranged between the sphere and the end face of the switching bolt, said spring means being located between the disc and the end face, and holding means for retaining the sphere on the end face of the switching bolt, said holding means having a sleeve-shaped section accommodating the sphere, an end of said sleeve-shaped section being structured as a stop for the disc and said spring means and said disc being located in a recess provided in the end face of the switching bolt so that the spring means presses the disc elastically against the end of the sleeve-shaped section acting as the stop for the disc so as to prevent motion of the disc in an axial direction and the sphere contacts said disc but is held in said holding means rotatably, but substantially free of play and substantially free of pressure from the spring means.

2. Starting device as defined in claim 1, wherein the recess in the switching bolt holding the spring means and the disc has an end section having a diameter greater than a remaining portion of the recess and said sleeve-shaped section has a flange held in said end section of said recess, said flange being located at one end of said sleeve-shaped section and at the other end of said sleeve-shaped section a circular hole is provided in said sleeve-shaped section, said circular hole having a peripheral edge on which the sphere rests and protrudes from said sleeve-shaped section.

3. Starting device as defined in claim 1, further comprising a covering cap having a bottom, said covering cap being mounted on the end face of the switching bolt, and wherein the sleeve-shaped section acts a spacing sleeve and said sleeve-shaped section has one end face on which said disc is pressed by said spring means and another end face resting against the bottom of the covering cap.

4. Starting device as defined in claim 1, wherein the switching bolt, the sphere, the disc and spring means and the holding means are provided together in a preassembled structural unit.

* * * * *